United States Patent [19]

Peters et al.

[11] Patent Number: 5,044,301

[45] Date of Patent: Sep. 3, 1991

[54] AUTOMATIC FLAG UNFURLER

[75] Inventors: Jack Peters, 806 Eastwood Dr., Prescott, Ariz. 86303; Jack T. Melton, Prescott, Ariz.

[73] Assignee: Jack Peters, Prescott, Ariz.

[21] Appl. No.: 481,236

[22] Filed: Feb. 20, 1990

[51] Int. Cl.[5] ..... G09F 17/00

[52] U.S. Cl. ..... 116/174; 116/173

[58] Field of Search ..... 116/173, 174

[56] References Cited

U.S. PATENT DOCUMENTS

| | | | |
|---|---|---|---|
| 689,077 | 12/1901 | Griffith . | |
| 756,989 | 4/1904 | Suhr | 116/174 |
| 1,048,291 | 12/1912 | Buckley | 116/174 |
| 1,061,041 | 5/1913 | Buckley | 116/174 |
| 1,061,042 | 5/1913 | Buckley | 116/174 |
| 1,069,776 | 8/1913 | Foulis . | |
| 1,148,362 | 7/1915 | Dahlberg . | |
| 1,194,489 | 8/1916 | Earle | 116/174 |
| 1,236,417 | 8/1917 | Finn . | |
| 1,295,274 | 2/1919 | Crichton . | |
| 1,306,915 | 6/1919 | Klamroth . | |
| 1,554,758 | 9/1925 | Post | 116/174 |
| 1,855,824 | 6/1931 | Crichton | 116/173 |
| 2,672,118 | 3/1954 | Martin | 116/174 |
| 2,853,046 | 9/1958 | Meade | 116/173 |
| 3,595,202 | 7/1971 | Visitacion | 116/174 |

*Primary Examiner*—William A. Cuchlinski, Jr.
*Assistant Examiner*—John L. Beres
*Attorney, Agent, or Firm*—Pollock, Vande Sande & Priddy

[57] ABSTRACT

An apparatus for use on a flagpole with a central elongate pole, adapted for automatically unfurling and maintaining in an unfurled state a flag attached thereto comprises a squirrel-cage like assembly adapted for rotational mounting about the axis of the pole with first and second spaced end plates transverse to the axis and elongate members parallel to the axis and extending between the end plates. The elongate members are uniformly spaced about the periphery of the end plates to ensure that the squirrel-cage assembly is dynamically balanced for rotation about the central pole. Bearing members are equidistantly spaced and rigidly mounted between the squirrel-cage assembly and the elongate pole for providing low rotational friction between the assembly and the pole and to further ensure dynamical balance of the assembly. One of the elongate members is adapted for attaching to one elongate member an edge of the flag, whereby forces acting on the flag resulting either from its weight or as a result of wind blowing on the flag readily cause the assembly to rotate about the elongate pole and thereby cause the unfurling of flag.

16 Claims, 2 Drawing Sheets

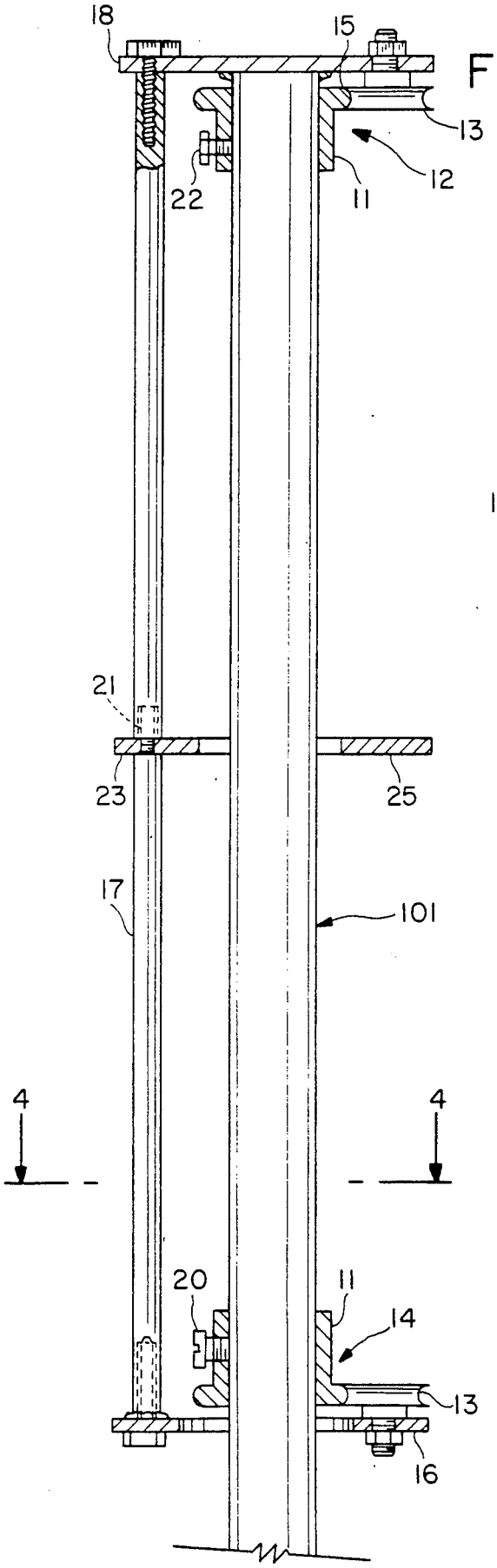
FIG. 3
FIG. 4
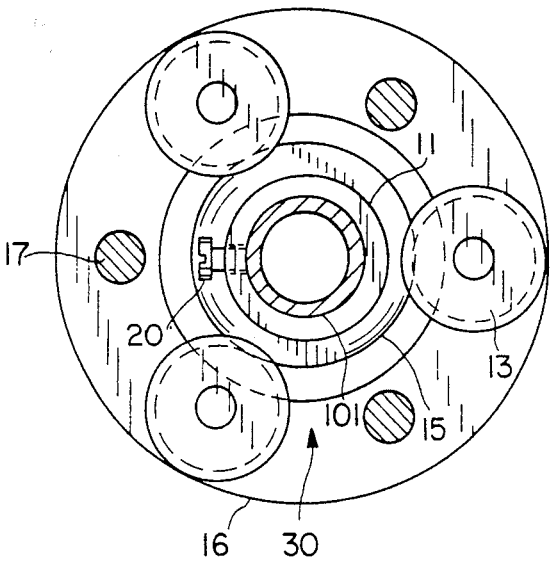
FIG. 5
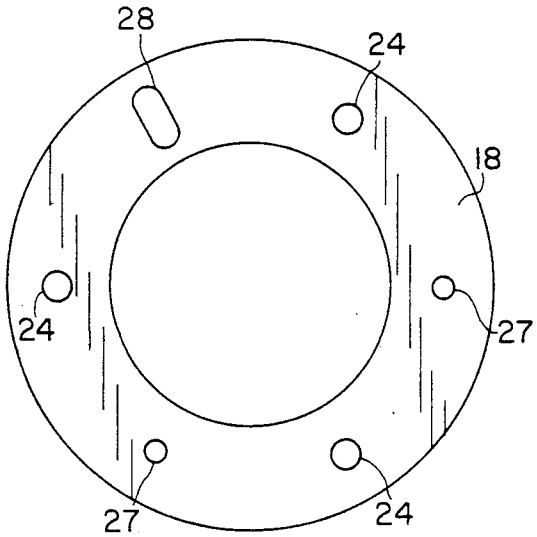

FIG. 1
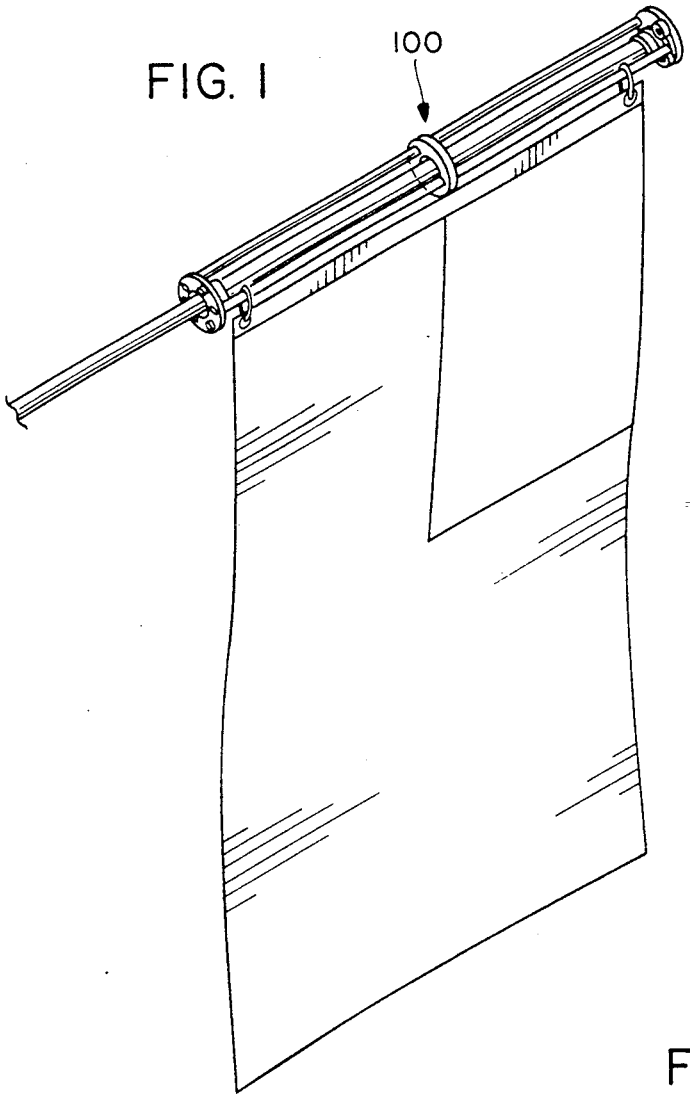
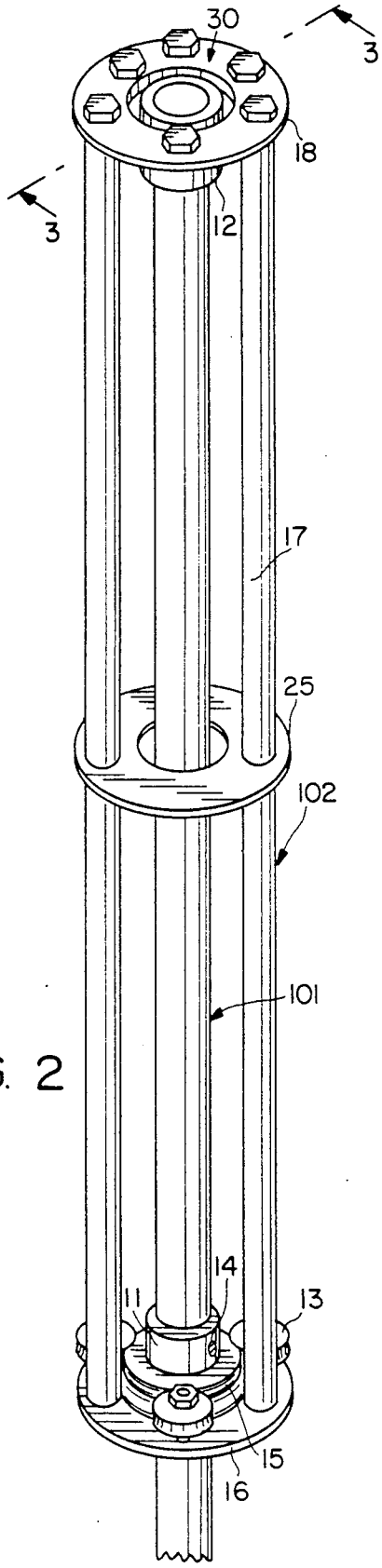
FIG. 2

AUTOMATIC FLAG UNFURLER

BACKGROUND OF THE INVENTION

The present invention relates to a flagpole for hoisting a flag, and particularly to a flagstaff having means for automatically unfurling the flag and for maintaining the flag in an unfurled state.

When the flag is ordinarily mounted on the flagpole, there is a tendency for the flag to furl itself around the pole due to diverse wind currents. In most situations, it is necessary to physically unfurl the flag since it usually wraps itself far beyond the point of having any diverse wind currents capable of unfurling the flag.

Attempts have been made in the past to provide means for maintaining a flag on a pole in a proper hanging position. Some of such prior art flagstaffs use ball bearings for rotation of the member for holding the flag and use the flagstaff as the shaft for the ball bearings. The use of single-shaft mounted ball bearings prevents such prior art flagstaff assemblies from achieving rotary balance and also do not allow for proper alignment of the bearings at all times. Consequently, such devices are not capable of providing efficient automatic unfurling of the flag.

Therefore, a need still exists in the art for providing a simple structure of a flagpole having means ensuring easy, efficient and automatic unfurling of the flag to maintain the flag on a pole in the proper hanging position.

SUMMARY OF THE INVENTION

It is an object of the present invention to provide a flagpole structure including means to prevent a flag from wrapping around the pole and instead hold the flag in its proper position.

It is another purpose of the present invention to provide means for automatically unfurling a flag so that the flag can be maintained in an unfurled condition at all times.

It is another purpose of the present invention to provide an unfurling device which is simple in structure and easy to maintain.

It is still another purpose of the present invention to provide a flagpole structure in which the flag can be easily lowered and raised.

All of the above objects are accomplished by the structure of the present invention in which an apparatus for use on an elongate flagpole comprises a squirrel-cage like assembly adapted for rotational mounting about the axis of the flagpole and including first and second spaced rolling end plates transverse to the axis and elongate members parallel to the axis and extending between the end plates. The elongate members are uniformly spaced about the periphery of the end plates to ensure that the squirrel-cage like assembly is dynamically balanced for rotation about the pole. Bearing means are equidistantly spaced and rigidly mounted between the squirrel-cage like assembly and the elongate pole for providing low rotational friction between the assembly and the flagpole to further ensure dynamical balance of the assembly. Also, means secured to one of the elongate members are adapted for attaching to the one elongate member an edge of the flag, whereby forces acting on the flag resulting either from its weight or as a result of wind blowing on the flag readily cause the assembly to rotate about the elongate pole and thereby cause the unfurling of the flag.

In one preferred embodiment, the present invention apparatus comprises a pair of sleeve-race units mounted longitudinally adjustably on the pole at spaced locations. At least two circular rolling plates are provided, each plate being fitted near one of the sleeve-race units. At least three rods extend between the two rolling plates and are positioned at an equal distance from each other about the periphery of the rolling plates. The rolling end plates and the rods extending therebetween constitute the squirrel-cage like assembly. One of the rods is adapted for attachment of the flag thereto. At least three concave bearings are secured to each rolling plate at the surface of the plate which faces the sleeve-race unit. The three bearings together with the sleeve-race units constitute the bearing means of the apparatus. The concave bearings are positioned at an equal distance from each other about the hub of the respective rolling plate. The race portions of the sleeve-race units are adapted to provide tracks for rotation of the concave bearings.

The present invention will now be described in more detail with reference being made to the accompanying drawings, wherein:

BRIEF DESCRIPTION OF THE DRAWINGS

FIG. 1 is a perspective view of a flag unfurling apparatus according to the present invention with a flag mounted thereon;

FIG. 2 is an enlarged detail of the present invention apparatus structure;

FIGS. 3 is a cross-sectional view taken along lines III—III' in FIG. 2;

FIG. 4 is a view taken along lines IV—IV' in FIG. 3; and

FIG. 5 is a detail showing the structure of the rolling plates.

DETAILED DESCRIPTION OF THE PREFERRED EMBODIMENT(S)

FIG. 1 shows an apparatus for unfurling a flag 100 according to the present invention with a flag mounted thereon. As best shown in FIGS. 2 and 3, an elongate flagpole 101, preferably made of aluminum, is fitted with two units 12,14 including a sleeve-race combination. The inner diameter of the sleeve-race combination unit is slightly larger than the outer diameter of the flagpole. The two sleeve-race units 12,14 are longitudinally, adjustably mounted on the pole at a distance from each other and can be locked at the sleeve portions 11 to the flagpole 101 by set screws 20,22. A squirrel-cage like assembly 102 is rotatably mounted on the flagpole. It includes two substantially planar rolling end plates 16,18, each being fitted near a respective one of the sleeve-race units 12,14. Also, it includes three elongate stabilizing rods 17 extending between the rolling plates 16,18. The rods are connected to the rolling plates, and uniformly spaced about the periphery of the plates to ensure that the squirrel-cage like assembly is dynamically balanced for rotation about the pole. The rods are preferably spaced 120° apart. In the preferred embodiment, each stabilizing rod is made of two parts which are interconnected through a male threaded stud 21 provided in one part of the rod which is screwed into a female threaded opening 23 in the second part of the rod. The rods are mounted parallel to the flagpole 101 and preferably at a distance of about 1" from the pole.

The rolling end plates and the stabilizing rods constitute parts of the squirrel-cage like assembly 102.

The apparatus also includes bearing means comprising sleeve-race units and at least three concave bearings 13 which are rigidly connected to a respective one of the rolling end plates 16,18. Each bearing 13 is rotatably inserted on a fixed axis supported on respective one of the rolling plates 16,18 and so positioned as to engage the inner surface of the rolling plate which faces the sleeve-race unit. The bearings 13 are equally spaced about the hub 30 of each of the rolling plates, preferably at 120° apart and alternate with the stabilizing rods 17. The concave bearings 13 are adapted to the race portion 15 of each of the sleeve-race combination units, as best shown in FIGS. 3 and 4. The internal diameter of the rolling plate is much larger than the outer diameter of the flagpole, and slightly larger than the outer diameter of the race portion of the sleeve-race unit.

The sleeve-race combination unit provides, through the race portion, a track for the concave bearings to ride on as they rotate around the flagpole. Such positioning of the concave bearings provides low rotational friction between the squirrel-cage like assembly and the flagpole and further ensures dynamical balance of the assembly. The sleeve portion 11 allows for the sleeve-race unit to be locked in place on the pole at any desired position, for example, at the extreme end of the pole and at a half-mast position. Also, it allows for easy unlocking of the rotating unit so that it can be removed as a whole unit from the pole. All of the above is accomplished by simply loosening, or tightening, one set screw which is within the sleeve portion of each sleeve-race combination unit.

As best shown in FIG. 5, in the preferred embodiment each rolling plate of the squirrel-cage like assembly is provided with six holes, three holes 24 for attachment of the rods, and the other three 27 adapted for receiving the screw means for rigid attachment of the concave bearings to the rolling plate. One of the holes designated for the bearings forms an elongated slot 28, such that one of the concave bearings can be raised up or down for adjustment through the elongated slot provided in the rolling plate. This allows the two non-adjustable concave bearings to be placed in position on the race portion first. When both non-adjustable concave bearings are in the correct position, the adjustable concave bearing is brought into contact with the race portion of the sleeve-race unit and tightened securely. This eliminates both vertical play and side wobble of the rolling plates. The three stabilizing rods are attached to the rolling plates via the attachment holes provided in the rolling plates and secured rigidly in place by bolts or screws.

Once totally assembled, the rolling end plates are rotated until free rotation is felt. This is accomplished by slidably adjusting the sleeve portion on the pole until minimum friction is felt between the concave bearings and the race portion. Once minimum friction is accomplished and the parts are rotating effortlessly, the set screw on the sleeve portion is tightened so that the sleeve portion cannot move slidably along the pole. Such assembled unit should be rotatable in almost perfect balance or with very little effort. After the flag is secured on one of the stabilizing rods, the weight of the flag alone will rotate the rotating unit and bring the stabilizing rod to which the flag is attached to the underneath portion of the pole.

The above structure of the apparatus for automatically unfurling a flag mounted on a flagpole, according to the present invention, provides various advantages. Provision of the concave bearings which are rigidly, facially mounted on the circular rolling plate and which ride on and rotate around the race portion results in a structure in which the proper, accurate alignment of the bearings is achieved and maintained. Also, by placing the concave bearings on a track which is provided by the race portion of the sleeve-race combination unit and not on the flagpole itself, two independent axes of rotation are created, namely that of the flagpole itself and of the bearings themselves with these two axes always being separate and parallel to each other during the rotation of the squirrel-cage like assembly.

The present invention apparatus is rotationally balanced due to the facial, rigid mounting of the bearings on the rolling plates, the provision of rods placed equidistantly along the periphery of the balanced circular rolling end plates, and the provision of circular race portions adapted to the shape of the concave bearings.

The attachment of the flag to one of the rods upsets the rotary balance of the flagpole device. When the flag is attached to any one of the three rods and the squirrel-cage like assembly is rotated due to the weight of the flag, the flag causes the rotating assembly to come to rest when the rod to which the flag is attached is at the bottom of the rotating assembly. When the flag is furled or wrapped around the rotating assembly, the wind or the weight of the flag itself will cause the assembly to rotate and unfurl. Because of the initially designed rotary balance, the flag has only its own weight to overcome in rotating the assembly and unfurling.

If the wind blows the flag such that it does furl around the rotating unit, the unit itself, because of its rotary balance, will rotate and unfurl the flag to its normal hanging position. There are several factors which contribute to the automatic unfurling of the flag, such as wind blowing against the remaining portion of the flag which will cause the unit to rotate clockwise or counter-clockwise. Also, the weight of the flag itself, if suspended above the bottom portion of the pole, will cause the unit to rotate, unfurling the flag, regardless of the wind. The flag, if furled around the squirrel-cage like assembly, is not subjected to friction between fabric and the pole, as would be experienced if the flag were furled and physically touching or being in contact with the stationary pole. The stabilizing rods keep the fabric of the flag from rubbing frictionally against the stationary pole portion around which they rotate, thus eliminating any possible fabric friction. Rotation of the unfurling unit is not limited to clockwise rotation. The unfurling unit will also rotate counter-clockwise in any easy manner.

In the preferred embodiment, another central circular plate 25 is provided, which is identical in size of the outer and inner diameters with the circular rotating plates. It is rigidly placed and centrally located between the two outer circular rolling end plates 16,18 and suspended only from the three rods. The central circular plate 25 includes rod attachment holes 24 allowing attachment of rods 17 via male stud and female openings 21,23. This plate provides rigid support to the rods and divides the whole unfurling assembly into two shorter, tubular shaped areas. The centrally located circular plate creates two tubular-shaped pockets in conjunction with the rods and flag material and helps to deflect the wind currents into these tubular-shaped areas when the flag is draped (not furled) over either end of the squirrel-cage like assembly.

In an embodiment which does not include the central plate, when the flag is furled around the entire rotating assembly, a tubular-shaped area is created via the rods and the flag material This tubular-shaped area in the preferred embodiment is approximately 3" in diameter and 36" long. Air currents enter into this area and by bulging and ballooning the flag material from within, thus helping in unfurling the flag by the rotating assembly.

By adding the central circular plate, that total tubular area is divided into two smaller tubular areas which are approximately 3" in diameter and 18" long. Thus, air currents are partially deflected through the central circular plate into the smaller tubular chamber formed by the flag draped over either end of the rotating assembly (not the entire unit) and assists in the undraping from that draped position via the same bulging and ballooning from within, as in a fully furled flag.

In prior art patents using single shaft mounted ball bearings, the size of the bearings is dependent upon the outer diameter of the shaft upon which they are placed. The change in the diameter of the shaft requires also the change of the inner and outer diameters of the bearings. Since the present invention device does not use single shaft mounted bearings, the size of the bearings is not dependent on the diameter of the shaft. Various sizes of the flagpoles can use the same size of the concave bearings with the present invention apparatus.

While a preferred embodiment of the present invention has been illustrated and described, it will be appreciated that various changes can be made therein without departing from the spirit and scope of the present invention.

We claim:

1. An apparatus for use on a flagpole with a central elongate pole, said apparatus adapted for automatically unfurling and maintaining in an unfurled state a flag attached thereto and comprising;

a squirrel-cage like assembly adapted for rotational mounting about the axis of said pole and including first and second spaced circular, substantially planar end plates transverse to said axis and elongate members parallel to said axis and extending between said end plates, said elongate members being uniformly spaced about said end plates to ensure that said squirrel-cage assembly is dynamically balanced for rotation about said central pole;

bearing means including bearing members equidistantly spaced and rigidly mounted between said squirrel-cage assembly and said elongate pole for providing low rotational friction between said assembly and said pole and to further ensure dynamical balance of said assembly, said bearing members having their axis of rotation fixed with respect to said end plates and separate and parallel with respect to said central elongate pole;

means secured to one of said elongate members for attaching to said one elongate member an edge of the flag; and whereby forces acting on said flag resulting either from its weight or as a result of wind blowing on said flag readily cause said assembly to rotate about said elongate pole and thereby cause the unfurling of flag.

2. An apparatus according to claim 1, wherein said bearing means includes a pair of sleeve-race units longitudinally, adjustably mounted at spaced locations on said elongate pole, each unit defining a circular race track portion for rolling said bearing members.

3. An apparatus according to claim 2, wherein said bearing members are concave bearings.

4. An apparatus according to claim 3, wherein at least three concave bearing members are rigidly mounted on each of said circular end plates at an equal distance about a hub of said plate.

5. An apparatus according to claim 4 wherein said bearing members are mounted at 120° apart.

6. An apparatus according to claim 5, wherein said circular end plate is provided with a radially-extending slot for permitting adjustment of one of said bearings with respect to said race portion of said sleeve-race unit.

7. An apparatus according to claim 6, further comprising a third circular plate located between said two circular end plates.

8. An apparatus for automatically unfurling a flag on a flagpole, comprising:

a pair of sleeve-race units longitudinally adjustably mounted at spaced locations on said flagpole at a distance from each other, each said unit defining a circular race surface along an outer edge thereof;

at least two rolling end plates, each plate being fitted over one of said sleeve-race units;

at least three rods extending between said two rolling plates, and being positioned at an equal distance from each other about the periphery of said rolling plates, one of said rods being adapted for attachment of the flag;

at least three disc-like bearings being concave along the outer periphery thereof secured to each rolling plate at the surface of said plate facing said sleeve-race unit, said bearings being positioned at an equal distance from each other about a hub of said rolling plate; and wherein race portions of said sleeve-race units provide a track for rotation of said disc-like bearings which is complimentary to the concave outer periphery of said disc-like bearings.

9. The apparatus according to claim 8, wherein said bearings are spaced about the hub of said end rolling plate at 120° apart.

10. The apparatus according to claim 9, wherein said rods are spaced about the periphery of said end rolling plate at 120° apart and alternate with said bearings.

11. The apparatus according to claim 10, wherein said rods include a first and a second part which are connected through a threaded hole, and a threaded stud provided respectively on said first and second parts.

12. The apparatus according to claim 8, wherein said end rolling plate is provided with a radially-extending slot for permitting adjustment of one of said bearings with respect to said roll portion of said sleeve-roll unit.

13. The apparatus according to claim 8, wherein said concave bearings are rigidly mounted to said rolling plates for maintaining alignment of said bearings.

14. The apparatus according to claim 12, wherein the diameter of said bearings is smaller than the diameter of said flagpole and wherein said bearings rotate around said flagpole with their axes being separate and parallel to said flagpole axis.

15. The apparatus according to claim 8, further comprising a third circular plate located between said two circular rolling plates.

16. The apparatus according to claim 13, wherein said third circular plate is supported by said rods.

* * * * *